United States Patent [19]

Rhodes

[11] 3,981,237

[45] Sept. 21, 1976

[54] PLASTIC ROTARY PRINTING SCREENS CONSTRUCTION METHOD THEREFOR

[76] Inventor: John M. Rhodes, Box 343, Summit, N.J. 07901

[22] Filed: Nov. 4, 1974

[21] Appl. No.: 520,736

Related U.S. Application Data

[63] Continuation-in-part of Ser. No. 334,267, Feb. 21, 1973, abandoned.

[52] U.S. Cl. ..... 101/128.2; 29/130; 29/458; 101/128.4; 156/73.4; 156/304; 228/110

[51] Int. Cl.[2] ..... B41C 1/14; B41N 1/24

[58] Field of Search ..... 29/130, 482, 458; 156/304, 73.4; 228/110; 101/128.2, 128.4

[56] References Cited

UNITED STATES PATENTS

| | | | |
|---|---|---|---|
| 1,800,360 | 4/1931 | Schroeder | 156/304 |
| 3,691,949 | 9/1972 | Giori et al. | 29/130 |
| 3,819,437 | 6/1974 | Paine | 228/110 |

FOREIGN PATENTS OR APPLICATIONS

| | | | |
|---|---|---|---|
| 19,997 | 1906 | United Kingdom | 29/130 |

*Primary Examiner*—Clyde I. Coughenour

[57] ABSTRACT

Plastic screens having the bending modulus, thinness, toughness, strength and chemical resistance which are suitable for use in rotary screen printing processes, are described. Methods for precision fabrication of such plastic rotary printing screens, having a wall thickness of about 0.002–0.025 inch, a circumference of 8 to 78 inches and a longitudinal length of about 48–200 inches, are provided.

9 Claims, 6 Drawing Figures

FIGURE 1
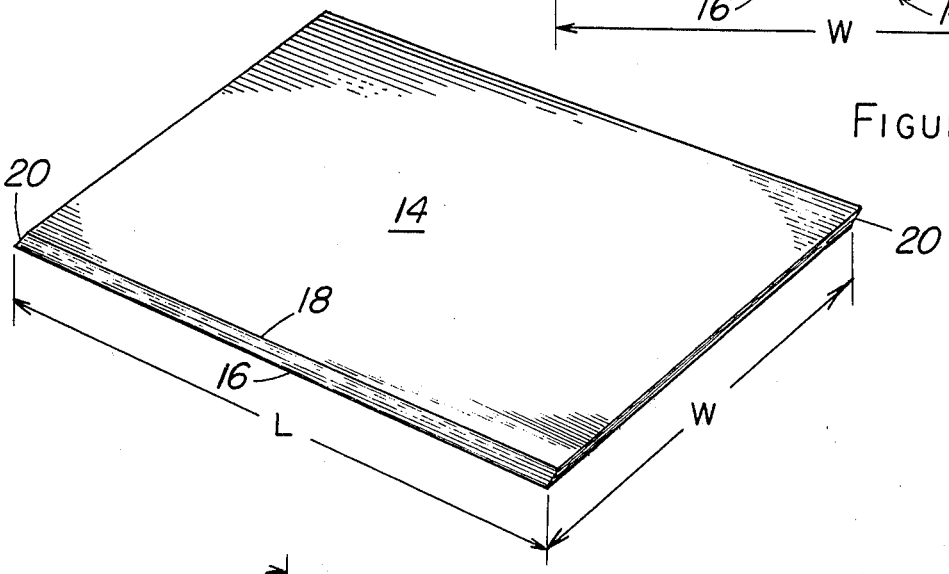
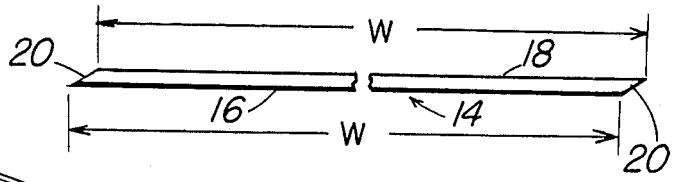
FIGURE 2
FIGURE 3
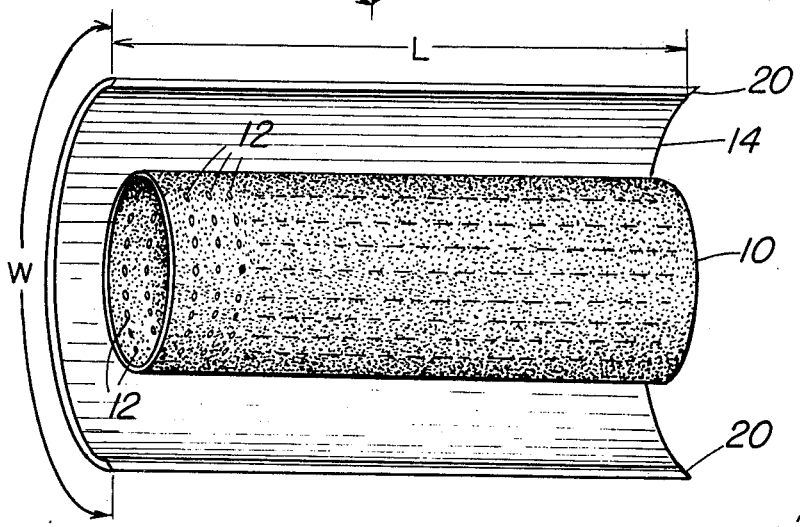
FIGURE 4
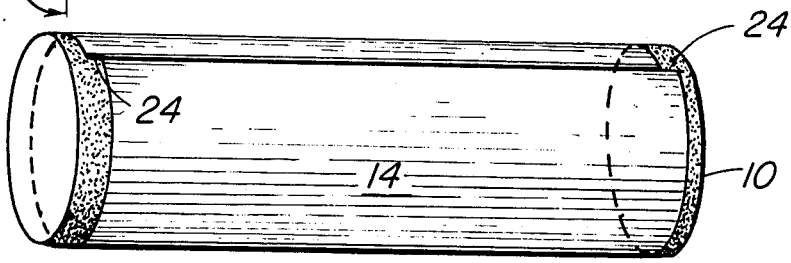
FIGURE 5
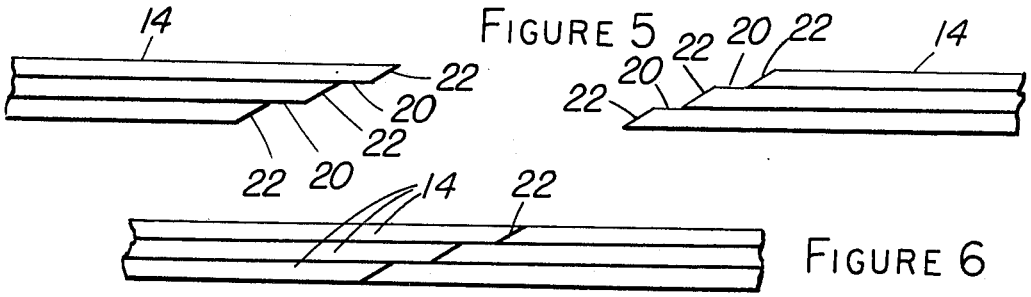
FIGURE 6

PLASTIC ROTARY PRINTING SCREENS CONSTRUCTION METHOD THEREFOR

This is a continuation-in-part of Ser. No. 334,267 filed Feb. 21, 1973, now abandoned.

BACKGROUND OF THE INVENTION

1. Field of the Invention

This invention relates to rotary screen printing, and especially relates to rotary screen printing of textiles. It particularly relates to rotary screen structures for unsupported use in rotary screen printing processes and construction methods therefor.

2. Review of the Prior Art

Until recent years there were two main systems for applying patterns to textiles by printing, namely: (1) flat bed printing and (2) roller printing. While flat bed printing is relatively inexpensive, it is an inherently intermittent process which offers a rate of production much too slow to satisfy the textile industry. Moreover, in flat bed printing the overlap between screens on a flat bed machine can easily cause smudges and crush the still-wet pattern of the adjacent but overlapped newly printed surface. Such defect is evidenced as "cross-bars." Consequently, it is important that printing pastes be compounded so that they are absorbed by the fabric immediately on application; otherwise, crushing is likely to result. The rate of production of roller printing, however, provides a multiple increase over flat bed printing, which it has essentially superseded. However, roller printing also requires higher costs and capitalization and thus a demand for longer runs. Consequently, with advances towards automation of textile production, there has been a growing need for a system of applying patterns to textiles which does not require the high capitalization of the roller printing machine and the vast runs and the large amount of down time that are common to the roller printing process.

Rotary screen printing is a process which apparently offers a solution to the foregoing problems and which is being increasingly accepted by industry. The apparatus utilized in this system comprises a perforated cylindrical or rotary screen which is utilized to apply colored designs to the textiles in the form of an emulsion or paste which is forced from the interior of the cylindrical or rotary screen through the perforations of the screen and onto the textile work-piece in a pattern according to the engraving of the rotary screen, as described, for example, in U.S. Pat. No. 2,276,181 for both belt and cylindrical screens.

Generally, the screen is relatively thin, e.g., about 0.08 to 0.20 mm (about 0.003 to 0.008 inches). In operation, the colored emulsion or paste is passed from a reservoir inside the rotary screen by means of a squeegee which controls emulsion application, but it is the contact of the outer area of the screen on the textile substrate which determines the amount of pressure applied to the actual print.

While rotary printing evidences many advantages, there are problems with the rotary screen itself and with the methods of its fabrication. Some of the earliest rotary screens were made by mounting a suitable stencil fabric of silk or thin flexible metal over a printing cylinder, as described in U.S. Pat. No. 2,276,113. Such rotary screens were operated in a textile printing machine as described in U.S. Pat. No. 2,928,340. Other early rotary screens were fabricated from phosphor bronze mesh, made first as a flat screen and then soldered at the repeat join to form a cylindrical screen which is mounted on a printing machine while stretched between circular metal end rings, as described in U.S. Pat. No. 2,906,201. Such screens, however, were hindered by the soldered join and the susceptibility to corrosion of the metal from which the screens were fabricated. Large open patterns and continual stripes could not be printed, and the screens did not have a long life. Subsequently, woven cylindrical bronze or stainless steel sleeves were utilized, but these also met difficulties in usage and color application.

An improvement was represented by the Galvano method which involved the electrolytic deposition of metal onto a matrix of steel which had previously been impressed with a specific number of dots corresponding to certain mesh sizes. The dots on the matrix were filled with a dielectric. When the resulting matrix was placed in a plating bath, a sheet was produced having perforations corresponding in size and number to the non-treated dots. Such rotary screens, however, often damaged easily and wore out quickly due to the corrosive action of the colored printing emulsions and pastes.

Another improvement was represented by the use of nickel for deposition on the mesh, as described, for example, in U.S. Pat. No. 3,482,300. Because nickel is relatively inert to the chemicals encountered in the emulsions utilized, it became the chosen metal for such depositions.

Another rotary screen developed by the art was an all-metal screen fabricated by photographing the desired design image onto the circular matrix and depositing nickel thereon to a specifically defined thickness, the result being an all-metal sleeve containing the design and the necessary perforations.

Both of the latter types of rotary screens, however, are also easily damaged, e.g., by corrosion, especially by acid dyes. They are also readily dented; the imperfections resulting therefrom show up in the resultant printing and are particularly unsatisfactory and costly, especially when such damage occurs during the peak of a long printing run. Another disadvantage, inherent in the known rotary screens, is the cost of fabricating the rotary screen itself because of the cost of preparation or of engraving the screen, as well as the cost of the metal, e.g., nickel, utilized therein.

Another recent development, disclosed in U.S. Pat. No. 3,759,800, is an obviously costly combination of a metal sleeve, which is etched to produce a desired hole pattern, and a woven or knit fabric of polyester or nylon, which is heat-shrunk thereonto, the etched sleeve and the shrunk fabric being conjoined by electrolytically deposited nickel having a thickness equalling two-thirds of the depth of the threads. As this patent points out, a rotary printing screen must have a given degree of rigidity and inherent strength, in order to be practical and usable in commercial processes, and must be as thin as possible, in order to achieve fine printing quality. Clearly, precision in construction (i.e., uniformity in diameter) is also needed in order to obtain uniform printing pressure, as noted in U.S. Pat. No. 3,587,458, because non-uniform diameter creates an irregular squeegee pressure and consequent irregular printing results.

Accordingly, there exists a clear need for a seamless rotary printing screen having the thinness, extremely high bending modulus, resistance to denting, and precise construction that have hitherto been solely available in metal screens and the chemical resistance of a silk or plastic sleeve. However, such a combination of desirable characteristics is very difficult to attain because of the rigorous requirements of rotary screen printing, particularly in that the screen must be mountable and usable without support. Consequently, the rotary screen must possess a minimum tensile strength of 10,000 psi and a maximum circumferential variation of ±0.1%. Ideally, the screen has a high folding endurance as measured by ASTM test D 2176-69. Thus, the material the screen is prepared from should exceed 100,000 cycles of this test.

SUMMARY OF THE INVENTION

It is an object of the invention to provide a precisely constructed plastic screen having the structural characteristics of a metal screen and the chemical inertness and printing characteristics of a silk screen for use in rotary screen printing.

It is a further object to provide a process for precision fabrication from plastic film of a rotary screen having the thinness, toughness, bending resistance and strength of a metal screen and the chemical inertness of a silk screen for use in rotary screen printing processes.

In satisfaction of these objects and in accordance with the spirit of this invention, a plastic rotary printing screen blank is herein provided that has the structural characteristics of a metal screen and the chemical inertness and printing qualities of a silk screen when formed of a certain narrowly defined class of plastics. Methods for precision fabrication of the blank into a cylinder or belt blank are further provided. A method for laser-beam perforation of such a blank to form a cylinder or belt rotary printing screen, having the necessary array of fine holes for printing a desired pattern, is additionally provided.

The invention is based upon a discovery that use of a plastic rotary printing screen enables excellent printing results to be obtained even though the screen has a thickness up to three times the thickness of a conventional metal screen. An unsupported rotary printing screen made of certain plastics is consequently provided as a cylinder blank having a thickness of about 0.005 inch to about 0.025 inch or as a belt blank having a thickness of about 0.002 inch to about 0.025 inch.

The invention is further based upon a discovery that only a certain narrowly limited class of plastics possesses the desired structural and chemical qualities, as hereinafter set forth.

It has been found that a plastic cylinder blank suitable for use as a rotary screen for rotary screen printing comprises a single or laminated sheet of thin plastic film which is conjoined at opposite edges to form a seam extending in the direction of the longitudinal axis of the blank. This seam is preferably a butt join and is essentially skewed with relation to any line on a surface of said cylinder blank which is parallel to the longitudinal axis thereof. The sheet of thin plastic film preferably is prepared from polyesters and/or copolymers of polyesters, especially polyethylene terephthalate, which are substantially inert to the printing emulsions or pastes utilized.

The plastic rotary screen printing blanks of the invention may be coated with various materials to improve their utility. For example, metal coatings may be applied by the conventional methods of chemical reduction, vacuum metalizing, cathode-sputtering, painting, etc. In addition, the blanks may be coated with a plastic or covered with a sleeve of a similar or different plastic material to impart desired surface characteristics.

DISCUSSION OF THE DRAWINGS

FIG. 1 illustrates a sheet of film from which the cylinder blank of the present invention is fabricated.

FIG. 2 illustrates a cross-sectional view of the sheet of FIG. 1 showing a preferred beveled edge.

FIG. 3 illustrates the sheet and the mandrel utilized in the instant invention.

FIG. 4 illustrates an embodiment of the instant invention wherein a plastic cylinder is positioned on the mandrel and has a skewed beveled butt join.

FIG. 5 illustrates a cross-sectional view of an embodiment of the instant invention wherein two compatible step-lap edges are formed from a three-layer laminate sheet.

FIG. 6 illustrates the join resulting from the laminate sheet of FIG. 5.

In accordance with the invention, a suitable surface, such as a cylindrical-forming mandrel 10 (see FIG. 3) of substantial length, i.e., at least about 50 inches up to about 250 inches or more and of substantially circular cross-section, i.e., from about 18 up to about 78 inches and more in circumference, is used as an anvil. Mandrel 10 is preferably of hollow construction and is provided with a plurality of minute orifices 12 extending through the cylinder wall and is also provided with suitable internal flow means to provide a flow path therethrough in order to evacuate the inner area thereof. The mandrel 10 may be produced from aluminum thick-wall tubing or aluminum pipe. A diameter tolerance of about 0.002 inch is desirable and can be achieved on a lathe by turning such mandrel by conventional means. If more critical tolerances are desired, they can be produced by grinding operations on the lathe.

As shown in FIGS. 1 and 2, a single sheet of film 14, having edges bevelled by conventional means so as to have the configuration set forth in FIG. 2 and a length (L), is utilized for fabricating a cylinder blank. The width of each surface 16 and 18 of the sheet has a dimension (W) which is from about 18 inches up to about 78 inches and is smaller than the desired circumference of the final plastic cylinder product in order to compensate for the skewing of the join of the laminate sheet. The thickness of the film utilized is sufficient to provide the final sheet thickness of about 0.002 to about 0.025 inch. Thus, if two sheets of film are laminated, at least one sheet has a thickness of from about 0.001 inch to about 0.012 inch.

The two faces 20 of the bevelled film are fabricated so as to provide a bevel angle of about 10° to 60°. The width of the join area is not generally critical but is dictated by the structural limitations of the conjoined film. The tolerance of the join, e.g., the space between the abutting edges of the film, is, however, extremely critical as any space at all is undesirable because it will hold ink emulsion and thereby print imperfections when subsequently utilized. Accordingly, this problem is minimized by using the beveled edges 20.

FIG. 3 illustrates the method of the instant invention wherein a length of film 14 is wrapped around a mandrel 10, with the machine direction of the laminate corresponding to the longitudinal direction of the axis. As shown in FIG. 3, the overall length (L) of the laminate is cut in excess of the final desired length of the cylinder product. Such excess area, as illustrated in FIG. 4, is subsequently evenly trimmed by conventional means.

In order to produce a plastic cylinder product having the exact circumferential dimensions desired, the film is skewed until the edges fit exactly, as illustrated in FIG. 4. The amount of skew is not necessarily critical. Enough skew must be provided, however, to insure manipulation of the film sheet in the manner set forth above so that the desired critical circumferential dimension is prepared. Generally, such skew, as represented in deviation from a line exactly parallel with the longitudinal axis of the mandrel and cylinder, is from about 0° to about 60° and preferably about 1° to about 5°.

In adjusting the skew, too much skew results in the cylinder circumference being too great with relation to the mandrel circumference; with too little skew, the circumference of the resulting cylinder will be too small, thus precluding a suitable join or a join at all. When the skew is satisfactory, the bevelled edges are sealed to make a suitable join. Generally, any one of a number of sealing methods or adhesive means as hereinafter set forth may be utilized to make the join, although an ultrasonic means is preferred.

FIG. 5 illustrates the positioning of a laminated sheet. In this embodiment the sheet consists of three individual layers, prior to joining. Accordingly, the terminal portions of the laminated sheet are positioned so that the bevelled edges 22 of each respective layer abut each other and so that the exposed or non-laminated area comprising the step or lap 20 of a sheet is contiguous, with the exposed area comprising the step or lap 20 of the immediately adjacent sheet. FIG. 6 represents the final join.

DESCRIPTION OF PREFERRED EMBODIMENTS

The structural characteristics of a metal screen which the plastic screen of this invention must equal or surpass are as follows. Thus, the screen must be

- tough, non-brittle, fatigue resistant and creep resistant
- solvent resistant including alcohols, ketones, aromatics, hydrocarbons
- acid, base resistant at room temperature and dimensional stability.

In order to resist denting, a sheet must additionally possess a high degree of stiffness, i.e., the material must possess a high modulus of elasticity, e.g., of at least $5 \times 10^5$ psi, so that it is elastic and requires a large force to produce an elastic deformation. This property is also of increasing utility with increasing width of the material being printed because bowing of a cylindrical screen can become increasingly serious with increasing length thereof, thereby greatly affecting register of patterns, wear on the squeegee blade, and printing pressure along the line of contact with the material being printed.

Other structural characteristics that are critically needed for a rotary printing screen are:

It must be non hygroscopic and exhibit a hard surface and be resistant to scratches.

Suitable polyester sheet or film materials which may be used in the present invention are formed from condensation products of a bi-functional dicarboxylic acid and a dihydric alcohol and possess dimensional stability at elevated temperatures. The preferred condensation products are formed with aromatic dicarboxylic acids; however, products formed with dicarboxylic acids such as adipic, sebacic, etc. are likewise acceptable. For instance, such polyesters may be of the type described in Carothers U.S. Pat. No. 2,071,250. The polyesters may be composed of any of the high-melting, difficultly soluble, usually micro-crystalline, cold-drawing, linear, highly polymerized esters of terephthalic acid and glycols of the series $$HO(CH_2)_nOH$$

wherein $n$ is an integer within the range of 2 to 10, described in Whinfield et al., U.S. Pat. No. 2,465,319. The particularly preferred polyester is polyethylene terephthalate.

However, the polyesters used in accordance with the present invention need not consist solely of dicarboxylic acid and simple glycol units because some of the glycol units may react to form polyglycols and small percentages of such polyglycol units may also be present. For instance, when ethylene glycol is a reactant, the polyester may contain from 1 to 15 percent by weight of diethylene glycol units, i.e., $-CH_2CH_2OCH_2-CH_2O-$.

Also contemplated are blends of suitable polyesters, such as blends of polyethylene terephthalate of different molecular weights or blends of a polyethylene terephthalate with a polybutylene terephthalate as well as blends of a suitable polyester with any polymer where the distinguishing and advantageous characteristics of the polyester are retained.

Preferably, the polyester which is utilized in the process is a heat-stable, highly polymeric, linear polyethylene terephthalate sheet which has been biaxially oriented and heat set to provide improved dimensional stability, such as described in Alles U.S. Pat. No. 2,779,684. Table I sets forth typical values for major characteristics and properties of a film made from polyethylene terephthalate.

TABLE I

| PROPERTY | |
|---|---|
| Machinability | Excellent general and laser machinability |
| Tensile strength psi | 25,000, (ultimate) 15,000 (5% elongation |
| Tensile modulus psi | 555,000 |
| Thermal expansion | $1.7 \times 10^{-5}$ inch/inch/°C. |
| Water absorption | Less than 0.8% (on 24-hour immersion at 23°C.) |
| Chemical Resistance | |
| Weak acids | High resistance |
| Strong acids | High resistance |
| Weak alkalies | High resistance |
| Strong alkalies | Good resistance |
| Organic solvents | High resistance |

The sheets of film utilized herein can be classified as commercially available products which are produced in widths up to 120 inches and wider but since the width of said film essentially corresponds to the circumference of the resultant cylinder, the width is not necessarily a limiting dimension. The thickness of the film may suitably range from about 0.001 to about 0.012 inch or more, depending on the number of layers used. Such films are laminated to prepare laminate films having the necessary step overlap of thickness ranging from about 0.002 inch to about 0.025 inch. One suitable film is duPont, Mylar Type "S" industrial polyester film.

In one embodiment, any one of a variety of adhesives, preferably thermoplastic, may be employed to bond the film edges at the join and/or to form the self-supporting laminate film sheet from the individual sheets of film. The particular adhesive utilized is dependent on the particular characteristics of the film as well as the final utility to which the cylinder will be applied, i.e., the degree of corrosion resistance, durability, etc., which is desired. In any event, the adhesive should be activatable and softened at temperatures which will not degrade the particular polymer utilized in the film.

While various well-known adhesives may be employed, advantages reside in the use of solutions, which, under the influence of heat, provide good binding power while remaining soft and flexible. Those adhesives found particularly useful in the method for the product of the invention include duPont Polyester Adhesive 46971 and Schjeldahl Polyester Adhesive GT-100.

The preferred method of sealing the abutting join involves a sealing together in a manner other than with adhesives. But even though the polyester employed as a film material is a thermo-plastic polymer, heat cannot be utilized to melt and weld the sealing surfaces together. Thus, the preferred method involves the use of ultrasonic sealing devices which literally vibrate the molecules at the sealing surface to make intimate contact with each other, thereby effecting a seal with the application of no external heat whatsoever. This method is particularly useful when oriented films are utilized, i.e., where the heat used to activate adhesives would tend to relieve the orientation and thereby weaken and shrink the film.

These methods and materials were employed in the following examples in which literature data and laboratory tests on the plastic films were supplemented by various tests on the manufactured rotary screen blanks and, after suitable perforation thereof, on the rotary printing screens, each being mounted on a Stork Rotary Printing machine, model no. RD-III, while printing polyester/cotton sheeting at 60 feet per minute.

An ultrasonic welding machine manufactured by Cavitron Ultrasonics Model No. 901, was used for conjoining opposed edges by welding at 800 watts, 0.2 sec dwell, 150 psi load.

For testing each manufactured cylinder for its bending modulus, a simple test fixture was devised. An 8 inch diameter cylinder was supported on a piece of lumber along the outer two inches adjacent each end and water was added inside the cylinder to simulate printing paste. Measurements of the downward deformation at the midpoint were taken for various depths of water in each cylinder until the cylinder buckled and collapsed.

In each test, a sheet of film, Mylar Type S polyethylene terephthalate having a width of 25.25 inches, was cut into three replicate sheets, each having a length of 60 inches. One sheet, randomly selected, was cut into test strips for physical tests and for accelerated corrosion testing in four typical printing emulsions, as follows:

| Emulsion Type | Time | Observation |
|---|---|---|
| 1. Varsol/water based polyester/cotton pigment paste | 7 days | No visible effect |
| 2. Water based polyester/cotton | 7 days | No visible |

-continued

| Emulsion Type | Time | Observation |
|---|---|---|
| pigment paste | | effect |

One sheet was formed into a cylinder on a mandrel, having a length of 60 inches and a diameter of 25.230 inches ± 0.015 inches, by following the procedures described hereinbefore and illustrated in FIGS. 1–4. The seam was sealed with duPont polyester Adhesive 46971. A second sheet was similarly sealed with Schjeldahl Polyester Adhesive GT-100. Non-destructive physical tests were conducted on the cylinder.

The third sheet was then formed into a rotary screen cylinder blank by means of ultrasonic welding, perforated with a test pattern to form a printing cylinder, and thoroughly tested on the rotary screen printing machine while using a selected variety of printing emulsions and textiles. An evaluation critique that combined the lengthy experience of several observers was finally conducted in order to categorize the plastic as to printing results, rigidity, corrosion resistance, ease of fabrication, etc. The results are combined in the following table:

| Material | Subjective Evaluation |
|---|---|
| Acetal | Acid attack. Brittle |
| Acrylic | Solvent attack |
| Allyl | Brittle thermoset |
| Cellulosics | Solvent attack. Hygroscopic |
| Epoxy | Brittle thermoset. Poor lasability |
| Polycarbonate | Brittle. Solvent attack |
| Polyimide | Poor lasability. Brittle |
| Polyamide | Some acid attack. Subject to creep. Hygroscopic |
| Polypropylene | Poor creep resistance |
| Polyvinyl chloride | Some solvent attack. Only fair lasability with dangerous vinyl chloride fumes emitted |
| Polyester | Generally good except not heat-sealable |

Another embodiment of the instant invention involves the metallizing of surfaces of the plastic cylinder so as to impart some of the characteristics provided by metals, e.g., nickel, gold, etc. The methods employed to deposit the metal involve coating by chemical reduction, vacuum metallizing, cathode-sputtering, painting, etc.

In general, the formation of a suitable adherent metallic film on the plastic cylindrical surface involves the following conventional steps: slight roughening or deglazing of the plastic surface, cleaning the roughened surface, sensitizing the cleaned surface, and forming the conductive film by chemical reduction, electrode deposition of an intermediate layer of metal, and, finally, application of the desired outer layer of metal. The formation of certain films, such as nickel, generally require an additional "activation" treatment following the sensitization of the plastic surface.

With regard to vacuum metallizing, the procedure generally employed for effecting the process involves the following steps: cleaning the plastic surface, if necessary, to remove grease, dirt, or mold release compounds which may adhere to said surface, application of a suitable lacquer base or undercoat, evaporation of the metal desired to be applied in a vacuum chamber having a suitable pumping system which is capable of evacuating the system almost to an absolute vacuum, and, if desired, application of a final coat or top coat of a lacquer.

The cathode-sputtering method involves an electron discharge effect. Sputtering, because the films are built up by molecular deposition, is a relatively slow process but is convenient for providing exceptionally thin coatings and desirably provides a means to ensure a film of complete uniformity and continuity. Cathode-sputtering is effected in a rarified atmosphere between two electrodes. One of these, the cathode, is the metal to be deposited as a sputtered film. The other, the anode, is of any suitable metal, e.g., aluminum or iron. The cathode is maintained at a high negative potential with respect to the anode and an intense electrostatic field is created between them. In this field, a relatively high concentration of ions or of residual gas is directed towards the cathode. If the plastic cylinder utilized herein is situated between the anode and the cathode and in the path of the stream of negatively charged cathode particles, it becomes coated with the cathode material or metal.

Another embodiment of the instant invention is predicated on desirability of having an entirely seamless rotary cylinder screen contact the surface to which the designs are to be imparted. While the instant invention essentially alleviates the problem of a detectable seam, an effectively seamless cylinder can be produced by utilizing a tube of heat-shrinkable polyolefins or other heat-shrinkable plastics which is slightly larger than the dimensions of the base cylinder and which can be shrunk over such cylinder. The outer layer must comprise a plastic material which is suitable to the utility to which it is applied. The resultant product is a precisely manufactured cylinder having the dimensional tolerances of the mandrel and the dimensional stability, toughness and bending modulus of the base cylinder while having the chemical inertness and seamless feature of the outer layer. If desired, an adhesive can be employed to laminate the two plastic materials together in the heat shrinking operation.

Yet a further embodiment of the instant invention is an entirely seamless cylinder which can be produced by utilizing conventional techniques. While the dimensions and tolerances required for the instant invention surpass those possible to maintain with traditional plastic extrusion processes, a two step extrusion process is possible by which seamless plastic cylinders having the required dimensions and tolerances can be produced. Accordingly, a tubular blank is first produced by conventional extrusion methods from a thermoplastic polyester resin such as poly(1,4-butylene terephthalate), polytetramethylene terephthalate, poly(cyclohexylenedimethylene terephthalate/isophthalate), or polyethylene terephthalate, either unfilled or filled with a reinforcing material such as glass fibers. The dimensions of this tubular blank are such that, after a biaxial drawing operation in which both radial and longitudinal dimensions are increased by 2 to 5 times, a seamless cylinder of the desired dimensions results. It is apparent that the wall thickness of the tubular blank must be the product of the axial and longitudinal draw ratios or, in the above cases, from 4 to 25 times the final desired cylinder wall thickness. Control of the final wall thickness uniformity thus is dependent on the control of a relatively thick wall during the continuous extrusion of the tubular blank and is, therefore, a relatively simple task. After the tubular blank is extruded, it is cut into lengths from ½ to 1/5 the final cylinder length depending on the desired draw ratio. The blank is then mounted inside a pressure vessel and situated such that one end enters an annular slit between a die and an expanding mandrel. The vessel is closed and hydraulic fluid is pumped into the vessel thereby forcing the blank to be extruded. Through this operation the tube is increased to the final desired diameter and at the same time is reduced in thickness and increased in length. There results a final seamless plastic cylinder, biaxially oriented for increased tensile strength, with wall thickness tolerance much tighter than could be achieved in a direct extrusion of such a thin walled cylinder. In order to reduce the pressure necessary for the hydrostatic extrusion operation, the pressure vessel, die, mandrel and hydraulic fluid can be heated.

The present invention also contemplates a rotary printing screen which is suitable for use in rotary screen printing operations and which is produced by subjecting a plastic cylinder blank, as hereinbefore described, to a controlled energized beam, e.g., laser beam, of sufficient intensity to decompose the plastic material and form minute holes which extend through the cylinder. The diameters of the holes formed thereby can be selectively varied by modulating the intensity of the incident laser beam.

Spatial arrangement of the perforations in the cylinder may be accomplished by revolving the plastic cylinder, by moving the laser, by deflecting the laser beam or by a combination of these. In order to produce a pattern, the laser pulses may be interrupted electronically or mechanically or a mask may be placed between the pulsing laser and the plastic surface of the cylinder according to a predetermined image. The plastic cylinder to be treated and the method and conditions under which the perforations are accomplished must be carefully selected if the resultant rotary screen is to be useful in rotary screen printing operations.

Accordingly, the energized beam employed must be capable of drilling holes of desired parameters into the plastic cylinders' workpiece. Generally, the minimum diameter of such may range from about 0.002 to 0.12 inch and usually will range from about 0.004 to 0.08 inch, being spaced from 0.01 to 0.17 inch apart. While energized beams such as electron or ion beam devices and lasers are contemplated herein, laser beams are preferred, with $CO_2$ lasers being especially preferred. The present invention employs a laser of either the pulsed or continuous type and includes a power supply and focusing devices. If a continuous wave (CW) laser is employed, it should be equipped with means to provide a pulsed beam on the workpiece. Such means comprises a shutter, a power interrupter, a rotating prism, or a modulator such as an acousto-optical or electro-optical modulator.

This invention also contemplates the copying of a perforated rotary screen from an original design. Thus, scanning means are provided for scanning a predetermined image. Such means are known to the art and may comprise either mechanical or electro-optical apparatus. Means are also provided for producing signals indicating the position or area of the perforation of said predetermined image being scanned as well as means responsive to said position signals for controlling the position of the laser beam apparatus relative to the cylinder to be perforated. There are also provided means responsive to an output signal for causing the laser beam to operate and to form a perforation in the cylinder blank.

It is apparent that engraving tools, i.e., energized beams, other than the laser may be employed within the spirit and scope of the present invention. For example, an electron beam might be used to form perforations in a plastic cylinder blank.

While the principles of the present invention have been illustrated by reference to a preferred embodiment and several modifications thereof, it will be apparent to those skilled in the art that other modifications and adaptations may be made without departing from the spirit and scope of the invention so that what is herein defined as such scope and is desired to be protected should be measured only by the appended claims.

What is claimed is:

1. In the manufacture of a rotary printing screen having perforations through which printing emulsions and pastes are forced for rotary screen printing of textiles while mounted on a rotary printing machine without internal support, an improved method for precision fabrication from plastic film of a plastic rotary printing screen having the thinness, extremely high bending modulus, resistance to denting, and precise construction of a metal screen, the chemical inertness of a silk screen, non-hygroscopicity, a scratch-resistant hard surface, and a maximum circumferential variation of ± 0.1%, comprising the following steps, in combination:

A. manufacturing a plastic blank according to the following steps:

1. providing a sheet of film of a high-melting, difficulty soluble, linear, highly polymerized ester of a bi-functional dicarboxylic acid and a glycol of the series $HO(CH_2)_nOH$, wherein $n$ is an integer within the range of 2 to 10, said sheet having a thickness of 0.002 to 0.012 inch, a length greater than the length of said plastic blank, opposite edges in parallel with the machine direction thereof, a width between said opposite edges that is less than the circumference of said plastic blank, a modulus of elasticity of at least $5 \times 10^5$ psi, and a capability of exceeding 100,000 folding cycles as measured by ASTM test D2176-69;
2. bevelling said opposite edges at a bevel angle of about 10°–60° to form bevelled edges;
3. wrapping said sheet of film around a mandrel, having an axis and a diameter tolerance of about 0.002 inch, with said machine direction generally corresponding to said axis and with said bevelled edges opposed and skewed by up to 60° from a line on the surface of said mandrel that is disposed in parallel with said axis, so that said bevelled edges abut each other to form a skewed seam and said wrapped sheet of film precisely conforms to the circumferential dimensions of said mandrel; and 4. conjoining said bevelled edges, so that said skewed seam is not detectable, and trimming said length to form said plastic blank; and B. perforating said plastic blank with a plurality of minute holes to form said plastic rotary printing screen for said rotary screen printing of said textiles.

2. The improved method of claim 1 wherein said plastic blank is manufactured by the further following steps:

A. providing at least two sheets of said sheet of film, each sheet having a thickness of 0.001 to 0.012 inch, and bevelling opposite edges of each said sheet of film at a bevel angle of 10°–60° to form said bevelled edges;

B. laminating said sheets of film to form a laminate in which said bevelled edges are stepwise spaced apart to form stepped edges;

C. wrapping said laminate around said mandrel with said stepped edges opposed and skewed to form said skewed seam; and D. conjoining said stepped edges so that said skewed seam is not detectable.

3. The improved method of claim 2 wherein said stepped edges of said laminate are adhesively conjoined with a polyester adhesive.

4. The improved method of claim 2 wherein said ester is polyethylene terephthalate which has been biaxially oriented and heat set and wherein said laminate possesses dimensional stability, excellent machinability, ultimate tensile strength of about 25,000 psi, tensile strength at 5% elongation of about 15,000 psi, tensile modulus of about 555,000 psi, thermal expansion of about $1.7 \times 10^{-5}$ inch/inch/°C, and water absorption after 24-hour immersion at 23°C of less than 0.8%.

5. The improved method of claim 4 wherein said stepped edges are conjoined by ultrasonic welding.

6. The improved method of claim 1 wherein said plurality of minute holes have a minimum diameter of from about 0.002 to 0.012 inch and are spaced from about 0.01 to 0.17 inch apart.

7. The improved method of claim 6 wherein said plurality of minute holes are drilled into said cylinder blank by a laser beam of sufficient intensity to decompose said highly polymerized ester.

8. The improved method of claim 7 wherein said plastic rotary printing screen is coated on its outer surface with a metal.

9. The improved method of claim 1 wherein a heat-shrinkable plastic tube, having a diameter slightly larger than the diameter of said plastic blank, is heat-shrunk over said plastic blank and wherein said plurality of minute holes are perforated through said heat-shrunk plastic tube and said plastic blank to form said plastic rotary printing screen.

* * * * *